United States Patent [19]

Smith et al.

[11] 4,269,725

[45] May 26, 1981

[54] WASHING COMPOSITIONS

[75] Inventors: Eileen Smith, Runcorn; David A. Morgan, Queen's Park, both of England

[73] Assignee: Laporte Industries Limited, London, England

[21] Appl. No.: 892,966

[22] Filed: Apr. 3, 1978

[30] Foreign Application Priority Data

| | | | |
|---|---|---|---|
| Apr. 21, 1977 | [GB] | United Kingdom | 16701/77 |
| Aug. 5, 1977 | [GB] | United Kingdom | 32876/77 |
| Jan. 19, 1978 | [GB] | United Kingdom | 2263/78 |

[51] Int. Cl.[3] ..... C11D 10/02; C11D 7/02

[52] U.S. Cl. ..... 252/174.25; 252/174.15; 252/135; 252/179

[58] Field of Search ..... 252/89, 135, 140, 179, 252/137, 174.15, 174.25

[56] References Cited

U.S. PATENT DOCUMENTS

| | | | |
|---|---|---|---|
| 3,985,669 | 10/1976 | Krummel et al. | 252/135 |
| 4,040,972 | 8/1977 | Roebke et al. | 252/179 |
| 4,094,778 | 6/1978 | Denny et al. | 252/179 X |

FOREIGN PATENT DOCUMENTS

| | | | |
|---|---|---|---|
| 2538680 | 3/1976 | Fed. Rep. of Germany | 252/89 |
| 2283953 | 2/1976 | France | 252/117.25 |

*Primary Examiner*—Mayer Weinblatt

*Attorney, Agent, or Firm*—Larson, Taylor and Hinds

[57] ABSTRACT

The present invention provides washing compositions in which all or part of the detergent builder salt is provided by a mixture of zeolites 13X and 4A. Preferably the weight ratio of 13X to 4A is in the range of 50:50 to 85:15 and especially from 65:35 to 85:15. Especially in the preferred ranges of weight ratios the mixtures are generally more effective at total hardness removal from the wash water than would be expected from the hardness removing capabilities of the zeolites 13X and 4A by themselves, leading to improved washing performance of the composition. In some particularly desirable embodiments part of the builder salt comprises STPP, and in others a minor part of the builder salt comprises a glassy phosphate, preferably together with an ethyleneamine (methylenephosphonic acid) complexing builder salt.

The compositions of the present invention are suitable for cleaning, in particular, fabrics or hard surfaces.

5 Claims, No Drawings

WASHING COMPOSITIONS

The present invention relates to washing compositions and to processes for washing.

Conventionally washing compositions contain in addition to a surfactant, an alkali builder salt, which amongst other functions, imparts to solutions of the washing composition an alkaline pH, and removes from solution or in some way neutralises the effect of alkaline earth metal ions such as calcium and magnesium which could interfere with or otherwise render less efficient the utilisation of the surfactant. Conventionally, the builder salt has been an alkali metal phosphate, commonly sodium tripolyphosphate. However, in recent years, the problem of eutrophication in inland waterways has become apparent to an increasing extent. It is believed that phosphates contribute significantly to eutrophication, and that a significant proportion of the phosphate arises as a result of its incorporation in washing compositions. Accordingly, therefore, considerable efforts have been made to develop washing compositions having a substantially reduced phosphate content. Of the many substitutes that have been proposed for phosphates, one class which has the advantage of being produced from readily available materials is that of zeolites. Generally, zeolites having a general composition in the ranges $xNa_2O:Al_2O_3:ySiO_2$ where x is from 0.7 to 1.5 and y is from 0.8 to 6.0 have been proposed, but the zeolite that is normally selected from that range is Zeolite 4A. Now, Zeolite 4A is relatively efficient at removing calcium ions from solution, and we have confirmed that it is relatively inefficient at removing magnesium ions from solution. Both magnesium and calcium contribute to the total hardness of the water.

It is an object of at least some embodiments of the present invention to provide a washing composition which contains a zeolite and which has an improved capability for removing the magnesium from the solution than does zeolite 4A.

According to the present invention there is provided a washing composition containing at least one surfactant, zeolite 13X and zeolite 4A and optionally containing one or more of the other components which can be included in washing compositions.

Zeolite 13X, advantageously, as far as we are aware, not only can remove calcium from solution at a rate comparable to that of Zeolite 4A during the initial period of, e.g. one minute, when the washing composition is brought into contact with the liquor, but also can remove magnesium from solution more quickly and to a greater extent than does Zeolite 4A.

Zeolite 13X is characterised by a mole ratio of $xNa_2O:Al_2O_3:ySiO_2$ wherein x is from 0.8 to 1.2 and y is from 2.4 to 3.0, and zeolite 4A by $xNa_2O:Al_2O_3:ySiO_2$ wherein x is from 0.8 to 1.2 and y is from 1.35 to 2.35 and both, in practice, normally contain water of hydration. The x-ray diffraction pattern of a typical zeolite 13X is described in U.S. Pat. No. 3,013,990 column 2 lines 28 to 62, and that of zeolite 4A in U.S. Pat. No. 2,882,243 column 8 line 69 to column 11 line 18. Zeolites 13X and 4A must not be confused with any other zeolites having a mole ratio of soda to alumina to silica within the ranges described hereinbefore with respect to zeolite 13X or 4A but which do not have the characteristic x-ray diffraction patterns of zeolite 13X or 4A. Such other zeolites do not form part of the present invention.

The surprising and unexpected nature of the present invention can be seen by examining the capacity of various zeolites to remove calcium from solution. Now, even though Zeolite A has a much smaller window than Zeolite Y its capacity for removing calcium from solution is substantially better than that of Zeolite Y. On the other hand, Zeolite 13X having a similar window to Zeolite Y is substantially as good as Zeolite 4A, at least initially, whereas synthetic mordenite, a alumino silicate having a very high silica to alumina mole ratio and an even larger window is worse even than Zeolite Y. Thus, it will be seen that there is no simple relationship between, for example, window size and calcium removal capability. When the magnesium removal capability of the same zeolites is tested, it becomes immediately apparent that Zeolite 4A and mordenite are behaving substantially similarly, with mordenite being arguably better, and that Zeolite Y can remove magnesium to a limited extent whilst Zeolite 13X is more than twice as good as any of the other zeolites tested. It will thus be seen that whilst Zeolite 4A was arguably the best at removing calcium it was arguably the worst at removing magnesium. A comparison of the calcium removing and magnesium removing capabilities of the various zeolites emphasises the surprising and unexpected nature of the present invention, and in particular that a knowledge of the window size and calcium removing capacity gives no indication of the magnesium removing capacity of a zeolite.

Desirably, the properties of 13X and 4A in the washing compositions fall within the range of from 90:10 to 20:80, proportions herein being by weight of anhydrous zeolite unless otherwise stated. Within such a range, the proportion of calcium ions removed from solution appear to be substantially the same as that of zeolite 4A, whilst the proportion of magnesium removed from solution appears to be markedly better than that of zeolite 4A. Moreover, within this range, the proportion of magnesium ions removed is generally greater than would be expected by interpolation along a straight line graph from 100% for 4A to 100% 13X. Although the effect of high concentrations of sodium salts including builders, is to tend to compress the difference in magnesium removing capability between 4A and 13X, synergism between 13X and 4A in the aforementioned range of 90:10 to 20:80 is still readily observable. Also, there is some indication that within this range, the calcium removing capability of the mixture might also be slightly better than that of 4A or 13X by themselves, especially at the lower end of the range, that is to say where the proportion of 4A in the mixture is from 20 to 33%.

In preferred embodiments, 13X represents at least 50% of the mixture of 13X and 4A. Such a mixture is substantially between than 4A alone and is nearly as good as 13X by itself for removing magnesium, whilst retaining very good calcium removing properties, so that the mixture exhibits great versatility in its use, in that it can cope with water supplies having only a small proportion of the hardness in the form of magnesium salts right up to waters in which a substantial or major proportion of hardness is caused by magnesium salts. This is to be contrasted with 4A by itself, whose performance falls off significantly as the proportion of magnesium ions forming the hardness increases. In especially desirable embodiments, the proportion of 13X in the 13X/4A mixture is at least 65% and preferably is not more than 85%. Within the range of 65% to 85%, and especially at 75%±3%, the total hardness removal can often be at or close to the maximum in this range when at least 20% of the total hardness is caused by magnesium. Even when the proportion of total hardness attributable to the magnesium is less than 20%, the mixture is substantially as good as solely 4A at calcium removal, so that the mixture is suitable for such waters also. It will be seen, therefore, that the benefit of using a mixture of 13X and 4A, namely that of achieving optimal total hardness removal from waters containing a high proportion of magnesium does not lead to significant or substantial impairment of performance for waters having only a low magnesium content.

In practice, washing compositions according to the present invention can contain between 5 and 95% by weight of 13X/4A, preferably between 10 and 70% by weight. It will be recognised that the 13X/4A mixture is intended as a partial or full replacement for phosphates and that in general the 13X/4A mixture can be used in approximately the same or possibly slightly higher proportions in washing compositions as phosphates could be used, and that in determining the proportion, the intended use of the washing composition and how much other builder salt is present will normally be taken into account. Also, even within a broadly accepted term like heavy duty washing composition the normal ranges of proportion of builder in the composition can very widely from country to country, e.g. often being in the range of 10 to 40% in the U.K., but up to 70% in Germany. The washing compositions are not restricted to heavy duty washing compositions but can be compositions formulated for any given purpose which could alternatively contain phosphates as builder salt. Such compositions include light duty household washing compositions, machine washing powders and scouring powders, in addition to heavy duty general household washing compositions or those formulated for automatic washing machines.

In practice, it is preferable for both of the zeolites to have a particle size of less than 45$\mu$, preferably less than 30$\mu$ and particularly in the range of 0.1 to 10$\mu$.

It will be recognised that the benefit of reducing eutrophication caused by phosphates rises as the proportion of phosphate replaced by zeolites in the detergent builder mixture rises. However, we have surprisingly found a synergistic effect when a mixture of zeolites 13X and 4A is employed together with sodium tripolyphosphate (STPP) in a weight ratio of total zeolite to STPP in the range of 95:5 to 40:60. Such a synergistic effect appears to be absent when either of zeolites 13X or 4A alone is used together with STPP in a weight ratio in the same range. The synergistic effect is more pronounced when the proportion of 13X in the mixture of zeolites 13X and 4A falls within the preferred range of from at least 50% up to 85% w/w and more preferably from 65 to 85% w/w.

We have also found that by incorporating a minor amount, e.g. up to 5.0% by weight of certain complexing agents in such compositions, their performance in washing fabrics can be improved.

Consequently, in some highly desirable embodiments, the washing composition contains a mixture of Zeolites 13X and 4A together with a minor amount of a complexing agent selected from (a) glassy phosphates, (b) poly(alphahydroxy acrylic acid) and alkali metal salts thereof, and (c) ethyleneamine(methylenephosphonic acids) and alkali metal salts thereof.

According to a further aspect of the present invention, there is provided a builder composition suitable for incorporation in a detergent composition comprising zeolites 13X and 4A and a complexing agent selected from (a) glassy phosphates, (b) poly(alpha-hydroxyacrylic acid) alkali metal salts thereof, and (e) ethyleneamine(methylenephosphonic acids) and alkali metal salts thereof.

Herein, by the term "glassy phosphates" are meant compounds of formula $M_4P_2O_7(MPO_3)n$, wherein M represents an alkali metal cation, preferably sodium, and n is at least 2. Preferably detergent compositions according to the present invention contain from 0.1 to 4.0% by weight of the glassy phosphate, and especially at least 0.5% by weight.

It will be recognised that the term "ethyleneamine(methylenephosphonic acids)" indicates that the compounds are analogous to ethyleneamine carboxylic acids, methylenephosphonic acid groups replacing acetic acid groups. Examples of this class of compound are diethylenetriaminepenta(methylenephosphonic acid) and ethylenediaminetetra(methylenephosphonic acid). Such a compound can be used in the acid form or as an alkali metal salt thereof, suitably sodium or potassium salt. Preferably, a detergent composition according to the present invention contains from 0.1 to 4.0% by weight of either an ethyleneamine(methylenephosphonic acid) or its salt or poly(alpha-hydroxy acrylic acid) or its salt, or both. Thus, in particularly preferred embodiments, detergent compositions contain from 0.5 to 4.0% by weight glassy phosphate and from 0.5 to 4.0% by weight of a compound in class (b) and/or a compound in class (c).

The ratio of 13X and 4A can be in the range of 90:10 to 20:80, preferably at least 50:50 and especially desirably in the range of 65:35 to 85:15, when the composition contains a compound in classes (a), (b), or (c).

In addition to the aforementioned components, the composition contains preferably from 0.1 to 4.0% of one or more of classes (a), (b) and (c) herein described. In some especially desired embodiments, the detergent composition contains not only a compound in class (a) but also a compound in class (c) to a total amount of (a) and (c) of from 1 to 5% by weight. Especially desirably, the compound in class (c) is diethylenetriaminepenta(methylenephosphonic acid) or its alkali metal salt.

One way of forming washing compositions as described hereinbefore is to first form a premix of the detergent builder components which is then mixed with the remainder of the components in one or more stages to form the desired washing composition. Thus, a detergent builder composition according to the present invention can suitably comprise from 1 to 10% by weight of one or more of components (a), (b) and (c) and the remainder a mixture of zeolites 13X and 4A. Especially desirable builder compositions comprise from 1 to 10% of component (a), from 1 to 10% of either component (b) or component (c) or a mixture of components (b) and (c), and from 98 to 80% of the mixed zeolites 13X and 4A. It will be recognised that the formation of a washing composition containing from 10 to 40% by weight of said builder composition aforementioned inevitably contains from 0.1 to 4.0% by weight of one or more of classes (a), (b) and (c). However, if it is desired to use greater than 40% builder composition in the washing composition, it will be further recognised that the maximum amount of any of classes (a), (b) and (c) in the builder composition will decrease as the proportion of builder composition in the washing composition increases. Thus, for example, if the washing composition is to contain 60% builder composition then the maximum proportion of class (a) in the builder composition is 6.7% to give 4% in the washing composition. Preferably, the proportion of any of classes (a), (b) and (c), when present in the builder composition is between 3 and 7% by weight. Thus, preferred builder compositions comprise from 3 to 7% of class (a), from 3 to 7% of class (b) or (c) or a mixture of (b) and (c) and from 94 to 86% of a mixture of zeolites 13X and 4A. An especially desirable builder composition comprises from 3 to 7% of class (a), from 3 to 7% of class (c) and from 94 to 86% of a mixture of zeolites 13X and 4A. The amount of class (a) can be matched with the amount of class (b) or class (c) or a mixture of classes (b) and (c). It will be understood that in the builder composition, the mixture of Zeolites 13X and 4A is suitably that ratio desired in the washing composition, so that in practice, the ratio is preferably in the range of 65:35 to 85:15 for 13X:4A.

Other Components of the Washing Compositions

In addition to one or more detergent builders as described hereinbefore the washing compositions according to the present invention contain a surfactant (otherwise referred to interchangeably as surface active agent or tenside or tensio active agent) as described herein normally in an amount of from 5 to 95% and in many embodiments from 5 to 25% and preferably from 8 to 14% by weight of the washing composition. Other phosphate-free detergent builders described hereinafter can also be included, normally in an amount of not more than 50% of the washing composition, and often in the range of 0 to 10% of the washing composition, or together with any STPP, forming up to half the total weight of builder salt in the washing composition. The composition can also contain, if desired, a solid organic or inorganic active oxygen-containing compound, desirably in an amount of from 0 to 40% by weight, and preferably from 10 to 30% by weight, together if desired with one or more bleach activators. The composition can also include a filler or processing aid such as sodium sulphate suitably in an amount of from 0 to 40% by weight and auxiliary agents in a total amount of from 1 to 20% by weight of the washing composition, such auxiliary agents being known in themselves and include soil anti-redeposition agents, dye transfer inhibitors, optical brighteners, enzymes, stabilisers, corrosion inhibitors, bactericides, dyes, perfumes, foam inhibitors, absorbents and abrasives.

Surfactants

The surfactants which can be employed in washing compositions according to the present invention can be non-ionic, anionic, cationic, or amphoteric. Generally, the surfactants contain at least one hydrophobic group, e.g. an aliphatic hydrocarbon group containing at least 8 carbon atoms, and often from 10 to 26 carbon atoms, the aliphatic group often being acyclic, but sometimes containing an alicyclic group, or the hydrophobic group can be an alkaryl group containing at least six and preferably up to 18 aliphatic carbon atoms. The surfactant contains in addition at least one water solublising group for example a sulphonate, sulphate or carboxylic group which is linked either directly or indirectly to the hydrophobic group. Linking members can include residues of polyhydric alcohols containing etheric or esteric linkages, for example derived from ethylene glycol, propylene glycol, glycerine or polyether residues. The surfactants can be soap or be synthetic, for example as described in chapter 2 of Synthetic Detergents by A Davidsohn and B M Milwidsky, 5th Edition published in 1972 by Leonard Hill, London, and methods of making them are described in chapter 4 of the same book.

Amongst anionic surfactants described on pages 15–23 of the aforementioned book, sulphonates and sulphates are of special practical importance. The sulphonates include, for example, alkaryl sulphonates, and particularly alkyl benzene sulphonates, the alkyl group preferably being straight chain containing 9 to 15 carbon atoms, of which one of the most commonly employed is linear dodecyl benzene sulphonate. Other sulphonates which are useful as anionic surfactants include olefin sulphonates, obtained, for example, by sulphonating primary or secondary aliphatic mono-olefins, alkene sulphonates, especially linear alkene sulphonates, and hydroxy alkene sulphonates and disulphonates, especially 3-, 4-, and 5-, hydroxy-n-alkyl sulphonates in which the alkyl group contains any even number from 10 to 24 carbon atoms. Other desirable anionic surfactants include alcohol sulphates, preferably linear, having a chain length of at least 10 carbon atoms and sulphated fatty acid alkanolamides. Other sulphates comprise sulphated nonionic surfactants as for example alkylphenylethylene oxide ether sulphate in which the alkyl groups contain from about 8 to 12 carbon atoms and there are 1 to 10 units of ethylene oxide in each molecule. Yet other sulphate surfactants comprise alkyl ethyl sulphates where the alkyl group contains from 10 to 20 carbon atoms, preferably linearly and each molecule contains from 1 to 10 preferably from 1 to 4 molecules of ethylene oxide.

It is not generally intended that cationic detergents be present in the same composition as anionic surfactants, but when cationic detergents are used they are frequently quaternary ammonium salts such as tetraalkyl ammonium halides in which at least one of the alkyl group contains at least 10 carbon atoms or quaternary pyridinium salts substituted by an alkyl chain of at least 10 carbon atoms.

A considerable proportion of nonionic surfactants suitable for use in the present invention comprise condensation products of ethylene oxide and possibly propylene oxide. One class of such nonionic surfactants which is of special importance comprises water soluble condensation products of alcohols containing from C8 to C18 with an ethylene oxide polymer often containing at least 10 molecules of ethylene oxide per molecule of surfactant, e.g. from 10 to 30 moles of ethylene oxide. Particularly desirable nonionic surfactants comprise water soluble condensates of alkyl phenols or alkyl naphthols with an ethylene oxide polymer normally containing from 5 to 25 moles of ethylene oxide per mole of alkyl phenol or alkyl naphthol. The alkyl group normally contains from 6 to 12 carbon atoms and is frequently nonionic.

As an alternative to the hydrophobic moiety of the nonionic surfactant being linked to the hydrophilic moiety by an ether link as in alkyl phenol ethylene oxide condensates, the linkage can be an ester group. The hydrophobic moiety is normally the residue of a straight chain aliphatic acid containing from 10 to 22 carbon atoms and more particularly lauric, stearic and oleic residues. In one class of nonionic ester surfactants, the hydrophilic moiety comprises polyethylene oxide, frequently in the ratio of from 5 to 30 moles of ethylene oxide per mole of the fatty acid residue. It will be recognised that both mono and di esters can be employed.

Alternatively it is possible to employ as the hydrophilic moiety glycerol, thereby producing either mono or di glycerides. In a further group, the hydrophilic moiety comprises sorbitol. A further class of nonionic surfactants comprise alkanolamides in which a C10 to C22 amide is condensed with a polyethylene oxide or polypropylene glycol hydrophilic moiety or moieties. Semipolar detergents include water soluble amine oxides, water soluble phosphene oxides and water soluble sulphur oxides, each containing one alkyl moiety of from 10 to 22 carbon atoms and two short chain moieties selected from the groups of alkyl and hydroxyalkyl groups containing 1 to 3 carbon atoms.

Amphoteric surfactants include derivatives of aliphatic quatenary ammonium, sulponium and phosphonium compounds in which the aliphatic moieties can be linear or branched, or two of which can join to form a cyclic compound, provided that at least one of the constituents comprises or contains a hydrophobic group containing from about 8 to 22 carbon atoms and the compound also contains an anionic water solubilising group, often selected from carboxylic, sulphate and sulphonates.

Other builders which can be included can be inorganic compounds for example alkali metal silicates, carbonates, bicarbonates, or borates or they can be organic, as for example alkali metal salts of ethyleneaminepolycarboxylic acid, polyhydroxyacrylic acid, of acids like citric acid or gluconic acid.

The inorganic active oxygen-containing compound is normally selected from sodium perborate tetrahydrate or monohydrate, the addition product of sodium carbonate and hydrogen peroxide, commonly referred to in commerce as sodium percarbonate, and similarly sodium perpyrophosphate, and sodium pertripolyphosphate and alkali metal and ammonium persulphates. The organic active oxygen-containing compound is normally selected from the class of solid mono or di-peroxy acids such as mono or di-perazaleic, diperoxyisophthalic acid, diperoxyterephthalic acid, 4-chlorodiperoxyterephthalic acid, or aliphatic peroxy acids containing 10 to 20 carbon atoms alpha substituted by a sulphonate group, or alkali metal, preferably sodium, salts of any of them. Other suitable organic active oxygen-containing compounds include solid organic peroxides such as benzoyl glutaryl peroxide, diphthaloyl peroxide and its hydrogenated equivalents, and solid diacyl peroxides derived from any of the aforementioned peroxy acids. It will be recognised that the diacyl peroxides function not only as active oxygen-containing compounds in their own right, but can also function as a bleach activator in that by reaction with hydrogen peroxide produced from a solid inorganic compound in solution such as sodium perborate tetrahydrate or sodium percarbonate, a second peroxy acid species is produced from each molecule of diacyl peroxide. The invention composition can also contain any solid bleach activator as proposed hitherto, mainly of the N-acyl or O-acyl compounds. Compounds which are typical of the class of bleach activator which they represent include N,N,N',N',-tetraacetylmethylenediamine, or the corresponding ethylenediamine compound, which are typical of n-diacylated alkyl or alkalene amines, benzoic or phthalic anhydride, tetraacetylglycoluril, which is typical of acylated glycolurils. The aforementioned bleach activators are of particular importance, but others which can be employed fall within the class of N-alkyl-N-sulphonyl-carbonamides, N-acyl hydantoins, carbonic acid esters, triacylcyanurates, O,N,N'-tri substituted hydroxylamines such as O-Benzoyl-N,N-succinyl-hydroxylamine, N,N'-diacyl-sulphuryamides and 1,3-diacyl-4,5-diacyloxyimidazolidines.

The auxiliary agents which can be incorporated in compositions according to the present invention include the auxiliary agents in the classes specified hereinbefore which have been disclosed for incorporation in phosphate-containing compositions. By way of example, sodium carboxymethylcellulose is of practical importance as a soil anti redeposition agent and derivatives of diaminostilbenesulphonic acid, diarylpyrazolines and aminocoumarins are incorporated for brightening cotton and polyamide fabrics.

One convenient method of producing particulate solid compositions according to the present invention comprises the steps of first forming a paste or suspension of all the components of the composition with the exception of any active oxygen-containing compound and activator therefor, normally employing water, and thereafter converting the paste or suspension to the solid state by hot drying suitably at a temperature in the range of 100° to 250° C., preferably by spray drying, thereby forming a particulate solid material which in a later stage can be mixed or blended with the particulate active oxygen-containing compound and bleach activator, if any. In alternative methods of preparation, two or more pastes or suspensions could be formed, each containing one or more of the spray-driable components and dried separately, if desired. Thus, e.g. a suspension of all or part of the zeolites together if desired with any other builders, could first be formed and dried in the manner previously described and a second aqueous paste, suspension, or solution could be formed containing the surfactant and the residue of the builders and any other components (except the oxygen-containing component and activator therefor) which is separately dried as before, and then the various components are blended together in the solid state. Alternatively, a part of the surfactant may be incorporated in the builder composition that is separately dried. In a further alternative, where the surfactant is nonionic, all or part of the surfactant may be incorporated into or coated on the surface of the active oxygen-containing compound, especially when it is highly porous such as sodium perborate monohydrate, the proportion incorporated in this manner being no more than the proportion at which a reasonably free flowing product remains.

In use, washing compositions according to the present invention are dispersed or dissolved in a washing medium, typically water, and the article or object to be cleaned is brought into contact with the washing medium. In general, the washing medium will have a pH adjusted to within the range of pH8 to 12. It will be recognised that washing compositions according to the present invention are suitable for dissolution or incorporation in any aqueous medium. They are particularly suited to dissolution or incorporation in aqueous media containing a significant concentration of magnesium ions. In consequence, it will be seen that they are suited to dissolution or incorporation in a very wide range of aqueous media. The article or object to be washed can be any article or object currently so washed by conventional washing compositions. An illustrative list of such objects or articles comprises textile materials including both natural and synthetic materials such as cotton, linen, polyamides, polyesters, polyacrylonitriles, polyurethane and polyvinylchloride, and hard surfaces such as walls, floors, work surfaces, and household and industrial objects made of wood, plastic, metal, glass, stone or ceramics.

The washing compositions are normally incorporated in aqueous media in amounts of from 0.5 to 20 gpl, frequently from 1 to 10 gpl, giving in many cases a builder concentration in the range of 0.3 to 6.0 gpl. The washing process is normally carried out at a temperature of from ambient up to 100° C., and frequently from 30° to 90° C.

Having described the invention in general terms, the specific embodiments are disclosed hereinafter by way of example only, in which amounts and weight ratios of zeolites are shown on an anhydrous basis.

EXAMPLE 1

In this Example water containing 100 ppm total hardness in a 1:1 by weight ratio of calcium to magnesium was softened by the addition of 0.45 gpl of either 13X/4A mixture in the weight ratios indicated in Table 1, or (by way of comparison only) with solely 13X or 4A, Y or mordenite at 25° C. Samples were taken after a half or one minute and ten minutes and analysed for calcium and magnesium. The results, expressed as the percentage of calcium, magnesium and total hardness which have been removed from the water, are summarised in Table 1 below.

TABLE I

| Zeolite | 13X/4A wt ratio | Time Minutes | Hardness Removal % Ca | % Mg | % Total |
|---|---|---|---|---|---|
| 13X/4A | 1:3 | 1 | 89 | 43 | 66 |
| 13X/4A | 1:3 | 10 | 97 | 50 | 73 |
| 13X/4A | 1:1 | 1 | 77 | 49 | 63 |
| 13X/4A | 1:1 | 10 | 90 | 70 | 80 |
| 13X/4A | 3:1 | 1 | 89 | 65 | 77 |
| 13X/4A | 3:1 | 10 | 95 | 76 | 85 |
| 13X | | 1 | 80 | 71 | 75 |
| 13X | | 10 | 84 | 79 | 81 |
| 4A | | ½ | 70 | 8 | 39 |
| 4A | | 10 | 96 | 17 | 57 |
| Y | | ½ | 48 | 30 | 3 |
| Y | | 10 | 57 | 41 | 49 |
| mordenite | | ½ | 32 | 13 | 22 |
| " | | 10 | 36 | 25 | 31 |

From Table I, it can be seen that the optimal total hardness removal occurred using a mixture containing 75% zeolite 13X, not only after one minute but also after ten minutes.

EXAMPLE 2

In this Example, a similar procedure to that of Example 1 was followed, except that the water employed contained 250 ppm total hardness, again in a 1:1 by weight ratio of calcium to magnesium, and 1.6 grams per liter of zeolite or zeolite mixture was added to remove the magnesium and calcium ions. The result is summarised in Table II below.

TABLE II

| Zeolite | 13X/4A wt ratio | Time Minutes | Hardness Removal % Ca | % Mg | % Total |
|---|---|---|---|---|---|
| 4A | | 1 | 97 | 16 | 56 |
| 4A | | 10 | 97 | 29 | 63 |
| 13X/4A | 1:3 | 1 | 94 | 34 | 64 |
| 13X/4A | 1:3 | 10 | 98 | 56 | 79 |
| 13X/4A | 1:1 | 1 | 95 | 34 | 64 |
| 13X/4A | 1:1 | 10 | 97 | 81 | 89 |
| 13X/4A | 3:1 | 1 | 96 | 87 | 91 |
| 13X/4A | 3:1 | 10 | 99 | 93 | 96 |
| 13X | | 1 | 94 | 87 | 90 |

TABLE II-continued

| Zeolite | 13X/4A wt ratio | Time Minutes | Hardness Removal % Ca | % Mg | % Total |
|---|---|---|---|---|---|
| 13X | | 10 | 96 | 90 | 93 |

EXAMPLE 3

In this Example, water having a total hardness content of 250 ppm in an 3:1 weight ratio of calcium to magnesium was softened by the addition of 5 gpl. of a heavy duty detergent composition comprising sodium linear alkyl benzene sulphonate 8%, sodium carboxymethyl cellulose 1%, sodium sulphate 10%, sodium perborate tetrahydrate 25%, zeolite or zeolite mixture 32%, miscellaneous 0.5% and the balance sodium sulphate and water. The results are summarised in Table III below.

TABLE III

| Zeolite | 13X/4A wt ratio | Time Minutes | Hardness Removal % Ca | % Mg | % Total |
|---|---|---|---|---|---|
| 4A | | 1 | 94 | 28 | 77.5 |
| 4A | | 10 | 95 | 29 | 78.5 |
| 13X/4A | 1:3 | 1 | 92 | 50 | 81.5 |
| 13X/4A | 1:3 | 10 | 95 | 57 | 85.5 |
| 13X/4A | 1:1 | 1 | 92 | 64 | 85 |
| 13X/4A | 1:1 | 10 | 94 | 64 | 86.5 |
| 13X/4A | 3:1 | 1 | 92 | 64 | 85 |
| 13X/4A | 3:1 | 10 | 94 | 79 | 90 |
| 13X | | 1 | 90 | 64 | 83.5 |
| 13X | | 10 | 91 | 71 | 86 |

From Table III it can be seen that again, even in the presence of sodium salts, the mixture which removed total hardness best was that containing 75% 13X and 25% 4A.

EXAMPLE 4

In this Example, Example 3 was repeated, except that the detergent composition was used at a concentration of 8.5 gpl. The results are summarised in Table IV.

TABLE IV

| Zeolite | 13X/4A wt ratio | Time Minutes | Hardness Removal % Ca | % Mg | % Total |
|---|---|---|---|---|---|
| 4A | | 1 | 96 | 40 | 68 |
| 4A | | 10 | 96 | 50 | 81 |
| 13X/4A | 1:3 | 1 | 93 | 76 | 84 |
| 13X/4A | 1:3 | 10 | 98 | 80 | 90 |
| 13X/4A | 1:1 | 1 | 95 | 85 | 90 |
| 13X/4A | 1:1 | 10 | 95 | 85 | 92 |
| 13X/4A | 3:1 | 1 | 93 | 85 | 89 |
| 13X/4A | 3:1 | 10 | 95 | 85 | 92 |
| 13X | | 1 | 93 | 85 | 89 |
| 13X | | 10 | 94 | 90 | 93 |

From Table IV it will be seen that water is softened rather more rapidly than when the lower concentration, as in Example 3, is used. It will also be noted that under these conditions, a relatively high weight ratio of zeolite to hardness, the mixtures containing 50% or more 13X, behaved very similarly not only as to the rate at which the hardness was removed, but also to the extent to which removal occurred.

EXAMPLE 5

In this Example, washing compositions were prepared comprising:

| Component | wt % |
|---|---|
| Sodium linear alkyl benzene sulphonate | 8 |
| Sodium perborate tetrahydrate | 25 |
| Sodium silicate | 9 |
| E.D.T.A. | 1 |
| Suds Suppressor | 3 |
| Builder | 35 |
| Sodium sulphate/water | balance |

In order to determine its washing ability, the composition of Example 5 (Ex 5) was compared with an otherwise identical composition C1, the builder of Ex 5 comprising zeolite mix, 13X:4A of 3:1 anhydrous by wt. 32%, glassy phosphate, $Na_4P_2O_7(PO_3)_3$ 2% and diethylenetriaminepenta (methylenephosphonic acid) 1% and that of comparison C1 comprising entirely sodium tripolyphosphate.

The suds suppressor was saponified hydrogenated marine oil fatty acid, in all compositions. The washing performance of the two compositions were compared in the following way. Loads of fabrics were made up from artificially stained and aged desized white cotton swatches and items that had been soiled in normal domestic usage. In order to made the comparison as fair as possible, efforts were made to distribute the items such that the load washed by the invention composition was similar as regards composition and degree of soiling to the load washed by the comparison composition. The loads were washed in domestic automatic washing machines, employing a pre-wash at 40° C. and a main wash at 90° C. and both using 105 g washing composition in 20 liters of water. The water hardness was 14° German hardness equivalent to 250 ppm measured as $CaCO_3$, in which the mole ratio of calcium to magnesium was 3:1. The artificially stained swatches after washing were compared using an Elrepho reflectometer commercially available from Karl Zeiss, operated under simulated natural daylight conditions, and under simulated natural light by a panel of non-colour blind judges. The views of the panel as to stain removal were then statistically evaluated using the 4 point Scheffe preferance scale, and analysed on a 95% probability basis. The results obtained are shown in Table 5, in which a positive score for the mean difference indicates that the first product was preferred to the second product and a negative score indicates that the second product was preferred. The asterisk indicates that the mean difference was significant to at least 95% confidence level, when it appears in Tables 5, 6, 7 and 10.

TABLE 5

| | C1 v Ex.5 | |
|---|---|---|
| Stain | Mean Difference | Yardstick |
| Tea | −2.84* | 0.98 |
| Red Wine | −0.34 | 1.56 |
| Cocoa | −1.38 | 1.48 |
| Blood/Milk/Ink | −2.0* | 1.52 |
| Mud | −1.22 | 1.54 |
| Cocoa (milky) | −1.44 | 1.94 |
| Make-up | +1.00* | 0.86 |

From the above, it can be seen that except in the case of make-up, the composition according to the invention Ex 5 produced better stain removal, as judged by the panel. The difference is especially marked in the case of the tea and the combined blood/milk/ink stains, in both cases being well beyond the point at which on a 95% probability the difference was significant. It will be also noticed that in the case of cocoa and mud the mean difference was approaching the point at which it would become significant at the 95% probability. From the above results, it can be concluded that on balance the composition according to the present invention is better than the comparison washing composition which contained as detergent builder sodium tripolyphosphate.

EXAMPLE 6

In this Example, the washing composition Ex 6 was identical to that in Example 5 except that 2% by weight of the sodium salt of poly(alpha-hydroxyacrylic acid) was employed instead of 1% of diethylenetriaminepenta (methylenephosphonic acid). One again, it was compared with a comparison washing composition C2 which was the same as C1, but with the inclusion of an extra 1% of sodium tripolyphosphate. The comparison was effected in the same way as in Example 5 and the results obtained were as follows:

TABLE 6

| | C2 v Ex. 6 | |
|---|---|---|
| Stain | Mean Difference | Yardstick |
| Make-up | −0.66 | 0.72 |
| Cocoa (milky) | +0.38 | 1.18 |
| Mud | +0.34 | 1.82 |
| Tea | −1.44* | 1.04 |
| Red Wine | −0.56 | 0.66 |
| Cocoa | +0.56 | 1.68 |
| Blood/Milk/Ink | +0.34 | 0.72 |

From the above results, it will be seen that there was only one stain in which the difference detected was significant at the 95% confidence level. The result was in favour of the composition according to the present invention, Ex 6 as were results for two additional stains which very closely approached the 95% confidence level, namely those in respect of make-up and red wine. Although for the other stains, the comparison composition C2 was preferred, the mean difference was only 18%, 32%, 33% and 47% respectively of the yardstick, i.e. a much smaller difference than would be required for the difference to be significant at the 95% confidence level. From the above results, therefore, it can be seen that the invention composition at least matches on average the comparison composition.

EXAMPLE 7

In this Example, the washing composition Ex 7 was identical to that of Example 5, but employing 2% instead of 1% by weight of the diethylenetriaminepenta (methylenephosphonic acid). Two comparison compositions were prepared containing the same amount of sodium linear alkyl benzene sulphonate, 8%, sodium perborate tetrahydrate, 25%, sodium silicate, 9%, EDTA, 1%, sud suppressor, 3%, and as builder, either Zeolite 4A or sodium tripolyphosphate, 32%, and the balance water. The 4A zeolite-containing comparison is designated C3Z and the tripolyphosphate-containing composition C3P.

The washing performance of the compositions were tested using the test method disclosed in Example 1, but employing soft water having a hardness of 5° expressed as German hardness and approximately 83 ppm expressed as $CaCO_3$. The results are summarised in Table 7.

TABLE 7

| Stain | C3Z v Ex.3 Mean Difference | C3P v Ex.3 Mean Difference |
|---|---|---|
| Blood/Milk/ink | −0.86* | −1.33* |
| Red Wine | −0.85 | −0.65 |
| Cocoa | −1.17* | −0.96* |
| Tea | −1.87* | −0.44 |
| Gravy | −0.07 | −0.32 |
| Mud | −0.08 | +0.08 |
| Chocolate Pudding | +0.04 | +0.02 |
| Make-up | +0.02 | −0.71* |

From the above results it can be seen that the invention composition matched both the prior art compositions in respect of all stains (figures of +0.04 and +0.02 have no significance) and was markedly superior in respect of several stains, in particular tea, cocoa, red wine and blood/milk/ink. Thus, on balance, the composition Ex.7 was better than comparable compositions C3Z and C3P.

EXAMPLE 8

In this Example the effectiveness of mixtures of zeolite to sodium tripolyphosphate (STPP) in a weight ratio of 90:10 at removing hardness from water at 25° C. was measured. The total hardness was 250 ppm of calcium and magnesium in a weight ratio of 1:1 and the builder mixture used at 1.5 gpl concentration. The results are summarised in Table 8 below, results for 13X/STPP and 4A/STPP mixes being present for comparison only, and the 13X/4A/STPP mix having a weight ratio of 13X to 4A of 3:1 demonstrating the invention, and show the proportion of hardness removed by the zeolite portion of the builder mix.

TABLE 8

| Mix | % Ca Removed 2 min | % Ca Removed 10 min | % Mg Removed 2 min | % Mg Removed 10 min | % Hardness Removed 2 min | % Hardness Removed 10 min | % Hardness Remaining After All STPP Used |
|---|---|---|---|---|---|---|---|
| 4A/STPP | 89 | 89 | 26 | 43 | 58 | 66 | 18 |
| 13X/STPP | 80 | 80 | 54 | 54 | 67 | 67 | 17 |
| Mix/STPP | 82 | 88 | 54 | 60 | 68 | 74 | 10 |

From Table 8 it can be seen that not only was the 13X/4A/STPP mixture significantly the best at hardness removal, the hardness remaining after all the STPP was used up was much the lowest in the case of the 13X/4A/STPP mixture.

EXAMPLE 9

In this Example, a similar procedure to Example 8 was followed, differing only by use of a 50/50 mix of zeolite/STPP, and measuring the amount of free STPP remaining in solution after 10 minutes. The results are summarised in Table 9, 13X/STPP and 4A/STPP being present by way of comparison only. The Mix/STPP contained 13X, 4A and STPP in a weight ratio of 3:1:4.

TABLE 9

| Mix | % Ca Removed 2 min | % Ca Removed 10 min | % Mg Removed 2 min | % Mg Removed 10 min | % Hardness Removed 2 min | % Hardness Removed 10 min | % Free STPP Remaining After 10 mins |
|---|---|---|---|---|---|---|---|
| 4A/STPP | 42 | 40 | 3 | 3 | 23 | 22 | 4.3 |
| 13X/STPP | 32 | 35 | 3 | 3 | 18 | 19 | 0.0 |
| Mix/STPP | 35 | 46 | 6 | 14 | 21 | 30 | 14.1 |

From Table 9 it can be seen that the proportion of hardness removed by the zeolite portion of the builder mix has fallen from when it comprised 90%, but again after 10 minutes the Mix/STPP has removed a greater proportion of the hardness than has either the 13X or 4A zeolites, and that very significantly a substantial amount of STPP still remains in solution after 10 minutes, which would be free to perform the other useful functions of STPP, such as soil suspension.

EXAMPLE 10

In this Example, the washing performance of compositions was compared by the method described in Example 5. The components of the compositions in this Example were the same and in the same amounts as in the composition of Example 5 except that the builder in composition Example 10 was a 13X/4A/STPP mixture in a weight ratio of 3:1:4 and in the comparison composition C4 was a 4A/STPP mixture in a weight ratio of 50:50. The results of the washing trials are summarised in Table 10 below.

TABLE 10

| Stain | C4 v Ex.10 Mean Difference | Yardstick |
|---|---|---|
| Blood/Milk/Ink | −2.66* significant | 1.03 |
| Tea | 0.42 | 1.26 |
| Cocoa | −1.76* significant | 1.12 |
| Dirty Motor Oil | −0.26 | 1.32 |
| Make-up | −0.34 | 0.56 |
| Mud | 0.26 | 1.32 |

From Table 10 it can be seen that overall the Example composition was adjudged to be better than the comparison product at cleansing the various soils.

We claim:

1. A washing composition comprising from 5 to 95% by weight of at least one surfactant and from 95 to 5% by weight of a mixture of zeolite 13X and xeolite 4A, the weight ratio of zeolites 13X:4A being in the range of 85:15 to 65:35.

2. A composition according to claim 1 wherein both the zeolites have an average particle size in the range of from 0.1 to 10$\mu$.

3. A composition according to claim 1 containing in addition one or more phosphate builder salts.

4. A composition according to claim 3 wherein the phosphate builder is sodium tripolyphosphate.

5. A composition according to claim 1 containing a minor amount of a complexing builder comprising a poly ($\alpha$-hydroxyacrylic acid) or an alkali metal salt thereof.

* * * * *